US007445206B2

(12) United States Patent
Lee

(10) Patent No.: US 7,445,206 B2
(45) Date of Patent: Nov. 4, 2008

(54) SHEET PICK-UP DEVICE

(75) Inventor: Hsin-Wen Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 11/470,386

(22) Filed: Sep. 6, 2006

(65) Prior Publication Data

US 2007/0290430 A1 Dec. 20, 2007

(30) Foreign Application Priority Data

Jun. 16, 2006 (TW) ..... 95121538 A

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS 3,893,554 A * 7/1975 Wason ..... 464/40
4,527,683 A * 7/1985 Mathews ..... 192/111.12
4,778,168 A * 10/1988 Kashimura et al. ..... 271/4.1
4,934,686 A * 6/1990 Ono et al. ..... 271/117
5,435,539 A * 7/1995 Namiki ..... 271/114
5,624,109 A * 4/1997 Tanaka ..... 271/10.13
6,059,279 A * 5/2000 Wenthe, Jr. ..... 271/10.13
6,070,867 A * 6/2000 Tsurumi et al. ..... 271/114
6,382,619 B1 * 5/2002 Gustafson et al. ..... 271/117
6,390,463 B1 * 5/2002 Iwago ..... 271/118
2004/0207145 A1 * 10/2004 Chang ..... 271/117
2005/0001371 A1 * 1/2005 Otsuki ..... 271/113
2005/0194733 A1 * 9/2005 Asada ..... 271/117

* cited by examiner

*Primary Examiner*—Patrick H Mackey
*Assistant Examiner*—Howard Sanders
(74) *Attorney, Agent, or Firm*—Kirton & McConkie; Evan R. Witt

(57) ABSTRACT

A sheet pick-up device for use in a document feeder includes a driving shaft, a sheet pick-up arm and a spring clutch. The spring clutch includes a spring and a collar. A retractable claw segment is extended from the collar and sheathed by the spring.

5 Claims, 5 Drawing Sheets

SHEET PICK-UP DEVICE

FIELD OF THE INVENTION

The present invention relates to a sheet pick-up device, and more particularly to a sheet pick-up device having a single spring clutch.

BACKGROUND OF THE INVENTION

Image capturing apparatuses such as image scanners, facsimile machines, printers or copiers are widely used for capturing or scanning images of documents, photographs or films. As known, the image capturing apparatus usually has a document feeder for successively and continuously feeding many paper sheets. Typically, the document feeder has a sheet pick-up device in contact with the front edges of the documents so as to feed the paper sheets one by one.

Referring to FIGS. 1A and 1B, a schematic cross-sectional view of a sheet pick-up device of a document feeder is illustrated. FIG. 1A schematically illustrates the sheet pick-up device in a feeding mode. FIG. 1B schematically illustrates the sheet pick-up device in a ready mode. The sheet pick-up device 2 is disposed under an upper cover 3. The operation principles of sheet pick-up device in the feeding mode and the ready mode are illustrated as follows.

As shown in FIG. 1, when the document feeder 1 is operated in the feeding mode, a driving shaft 21 of the sheet pick-up device 2 is driven by a motor (not shown) to rotate in a direction R1, and a sheet pick-up arm 22 of the sheet pick-up device 2 is descended to a sheet feeding position. Meanwhile, a sheet pick-up roller 221 of the sheet pick-up arm 22 transports a document S forwardly and a sheet separation roller 222 of the sheet pick-up arm 22 is rotated to separate the top paper sheet from the stack of paper sheets, thereby picking a single paper sheet.

As shown in FIG. 1B, after the document S has been fed across the sheet separation roller 222, the driving shaft 21 is driven by the motor to rotate in a direction R2, the sheet pick-up arm 22 of the sheet pick-up device 2 rises up to a ready position.

The above document feeder 1 has several drawbacks. For example, when the driving shaft 21 is rotated in a direction R2 to raise the sheet pick-up arm 22 to the ready position, the motor is not instantly switched off. Since the driving shaft 21 is continuously driven by the motor, the sheet pick-up arm 22 may be further raised to strike the upper cover 3. Under this circumstance, undesirable noisy sounds are emitted and even the upper cover 3 is uplifted.

For avoiding generation of noisy sounds when the sheet pick-up arm 22 strikes the upper cover 3, the sheet pick-up device 2 should be improved. Referring to FIG. 1C, a schematic perspective view of the sheet pick-up device 2 is illustrated. The sheet pick-up device 2 of FIG. 1C is advantageous for reducing the possibility of striking the upper cover 3 and/or uplifting the upper cover 3 by the sheet pick-up arm 22. As shown in FIG. 1C, a clutching member 23 including two one-way spring clutches 23A and 23B is mounted on the driving shaft 21. When a sheet feeding operation of the document feeder 1 is initiated, the spring clutch part 23A is driven to descend the sheet pick-up arm 22. When the sheet feeding operation is terminated, the spring clutch part 23A is driven to raise the sheet pick-up arm 22 to the ready position. Next, when the sheet pick-up arm 22 is further raised to touch the upper cover 3, the spring clutch part 23B is operated to allow for idle running of the driving shaft 21, thereby reducing the possibility of striking the upper cover 3 and/or uplifting the upper cover 3 by the sheet pick-up arm 22. A sheet pick-up device which has two one-way spring clutches was disclosed in for example U.S. Pat. No. 6,390,463, the contents of which are hereby incorporated by reference.

Although the approach of mounting two one-way spring clutches on the driving shaft is advantageous for reducing the possibility of striking the upper cover and/or uplifting the upper cover by the sheet pick-up arm, there are still some drawbacks. For example, the extra one-way spring clutch increases cost and complexity of the sheet pick-up device.

In views of the above-described disadvantages resulted from the prior art, the applicant keeps on carving unflaggingly to develop an improved sheet pick-up device according to the present invention through wholehearted experience and research.

SUMMARY OF THE INVENTION

It is an object of the present invention to provide a sheet pick-up device having a single spring clutch so as to reduce the cost thereof and simplify the assembling process.

In accordance with an aspect of the present invention, there is provided a sheet pick-up device. The sheet pick-up device includes a driving shaft, a sheet pick-up, a collar and a spring. The sheet pick-up arm is pivotally coupled to the driving shaft. The collar is sheathed around the driving shaft and synchronously rotated with the driving shaft. A claw member is extended from an end of the collar. The spring is sheathed around the driving shaft, and includes a first end fixed to the sheet pick-up arm and a second end sheathed around the outer periphery of the claw member.

In an embodiment, the claw member includes a plurality of claw pieces enclosing a surface of the driving shaft, and the plurality of claw pieces are discretely arranged at a regular interval.

In an embodiment, a gap is formed between each claw piece and the surface of the driving shaft.

In an embodiment, the sheet pick-up arm comprises a sheet pick-up roller and a sheet separation roller.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
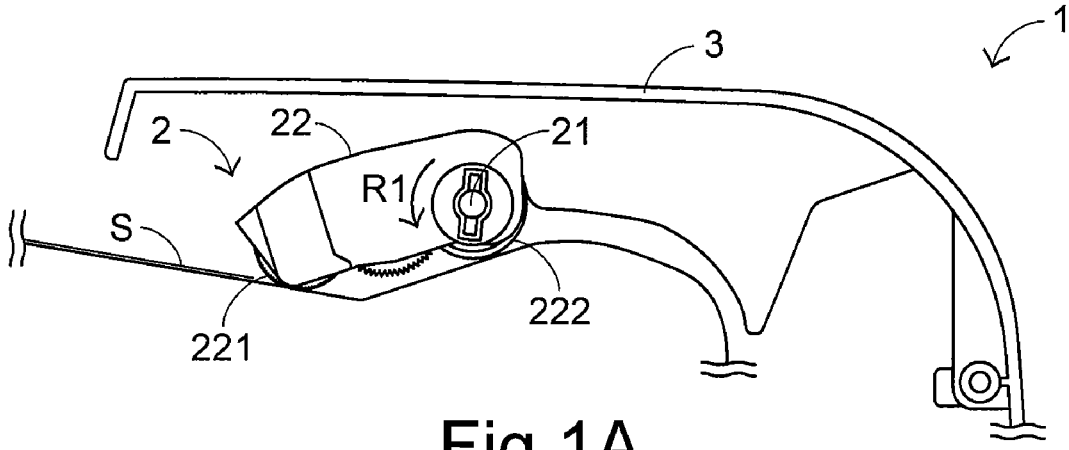
Fig.1A PRIOR ART
FIG. 1A schematically illustrates a conventional document feeder whose sheet pick-up device is in a sheet feeding position.
Figure 1B:
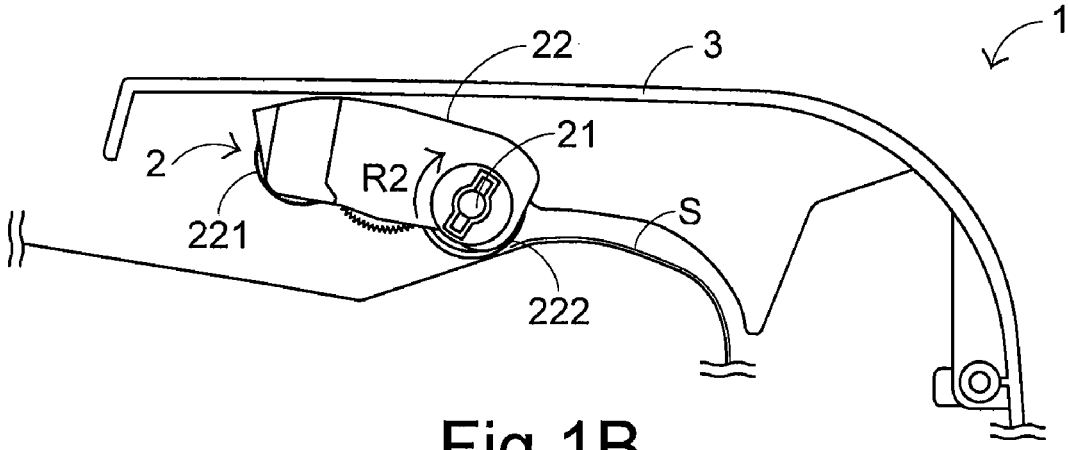
Fig.1B PRIOR ART
FIG. 1B schematically illustrates the conventional document feeder whose sheet pick-up device is in a ready position.
Figure 1C:
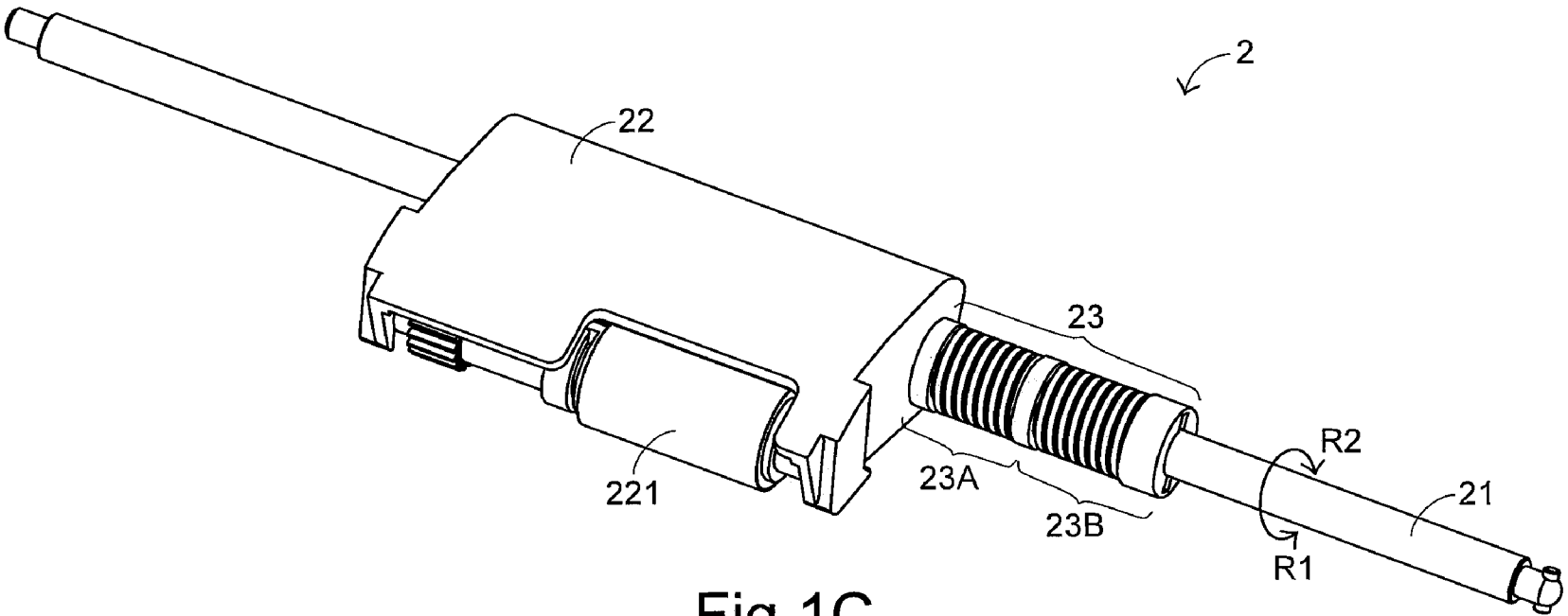
Fig.1C PRIOR ART
FIG. 1C is a schematic perspective view of the sheet pick-up device used in the conventional document feeder.
Figure 2A:
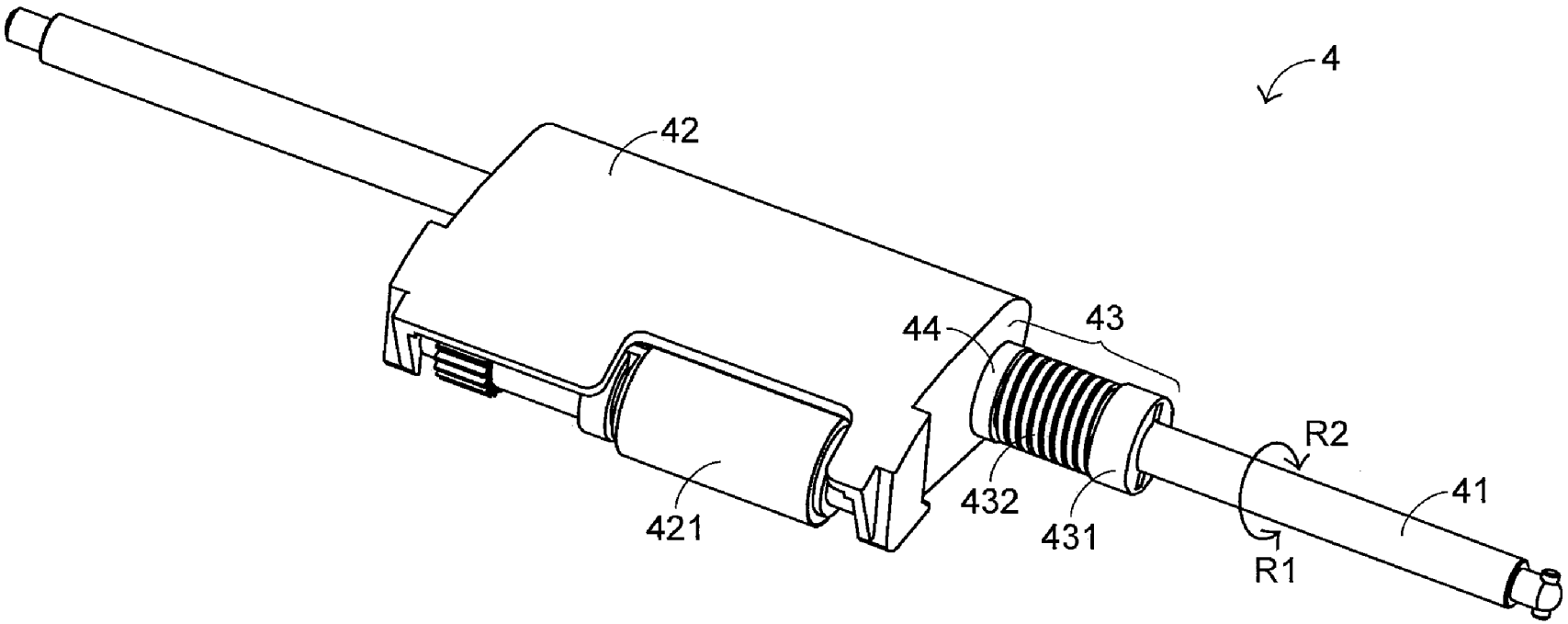
FIG. 2A is a schematic perspective view of a sheet pick-up device according to a preferred embodiment of the present invention.
Figure 2B:
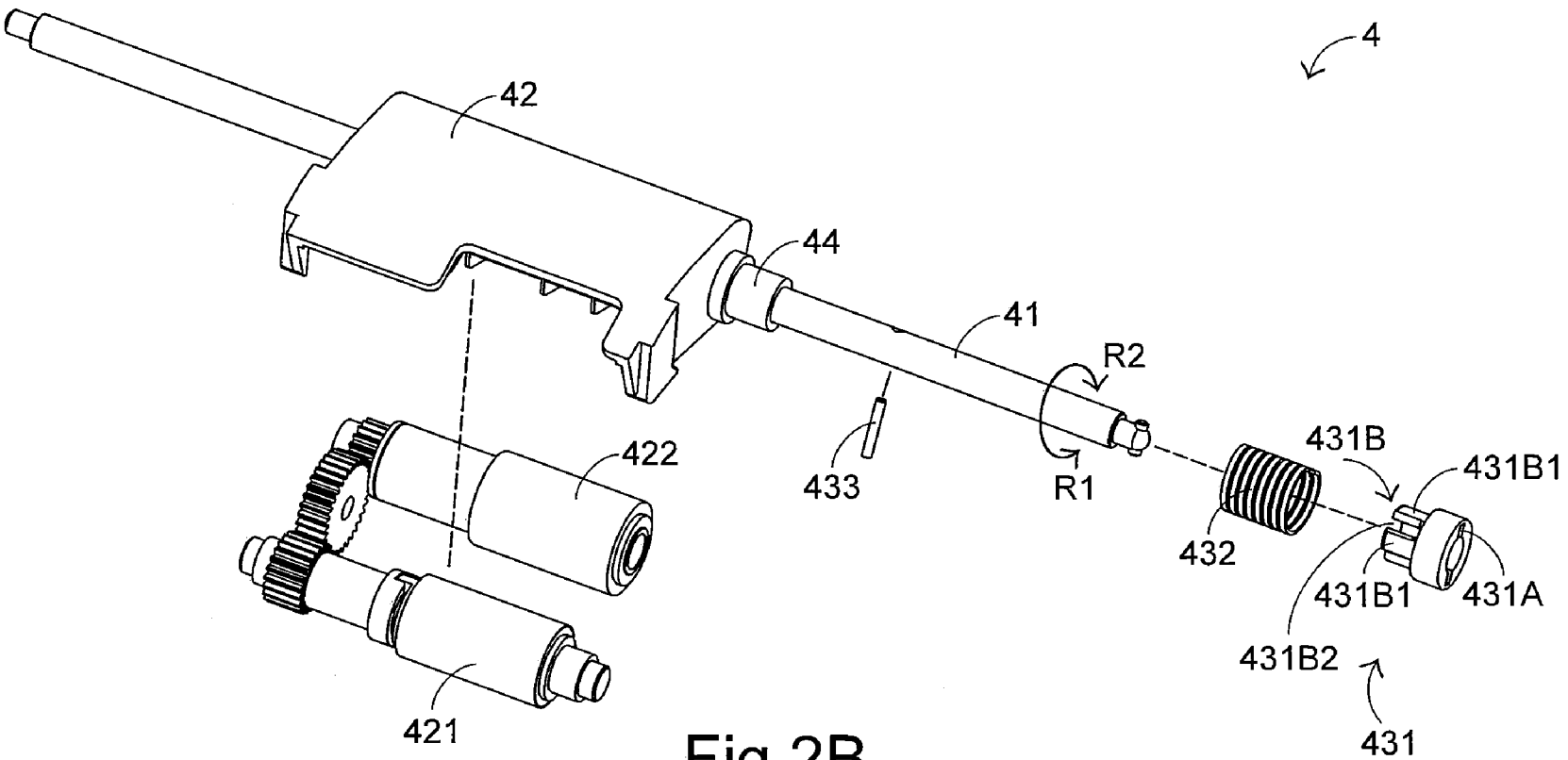
FIG. 2B is a schematic exploded view of the sheet pick-up device of FIG. 2A.

Referring to FIGS. 2A and 2B, schematic perspective and exploded views of a sheet pick-up device according to a preferred embodiment of the present invention are respectively illustrated.

As shown in FIGS. 2A and 2B, the sheet pick-up device comprises a driving shaft 41, a sheet pick-up arm 42 and a single spring clutch 43. The sheet pick-up arm 42 is pivotally coupled to the driving shaft 41, and includes a sheet pick-up roller 421 and a sheet separation roller 422. The driving shaft 41 is driven by a motor (not shown) to either descent the sheet pick-up arm 42 to the feeding position or raise the sheet pick-up arm 42 to the ready position.

Please refer to FIG. 2B. The spring clutch 43 includes a collar 431 and a spring 432. The collar 431 is sheathed around the driving shaft 41. An end of the collar 431 has an elongated recess structure 431A. By penetrating a retaining stick 433 though an aperture of the driving shaft 41 and engaging the retaining stick 433 with the elongated recess structure 431A, the collar 431 is fixed on the driving shaft 41 to permit synchronous rotation of the collar 431 and the driving shaft 41.

Figure 3A:
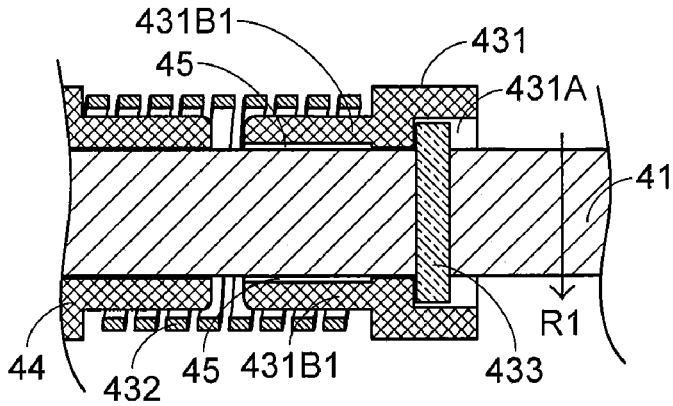
FIG. 3A is a schematic cross-sectional view illustrating the spring clutch when the sheet pick-up device is in a sheet feeding position.

Please refer to FIG. 2B again. A retractable circular claw member 431B is extended from the other end of the spring clutch 43 facing the spring 432. The retractable circular claw member 431B comprises a plurality of claw pieces 431B1 discretely arranged at a regular interval 431B2. When the collar 431 is sheathed around the driving shaft 41, a gap 45 is formed between each claw piece 431B1 and the driving shaft 41, as is also shown in FIG. 3A. Due to the existence of the interval 431B2 and the gap 45, when an oppressing force generated from the spring 432 is exerted on the claw member 431B, the claw member 431B is deformed toward the surface of the driving shaft 41.

Please refer to FIGS. 2A and 2B again. In the spring clutch 43 of this embodiment, a first end of the spring 432 is sheathed around a sleeve 44 extended from the sheet pick-up arm 42, so that the first end of the spring 432 can be fixed on the sheet pick-up arm 42. A second end of the spring 432 is sheathed around the outer periphery of the claw member 431B. Since the first end of the spring 432 is fixed on the sheet pick-up arm 42, in views of the operating principle of the one-way spring clutch, the spring 432 will be selectively relaxed or compressed according to the rotary directions of the driving shaft 41.

Figure 3B:
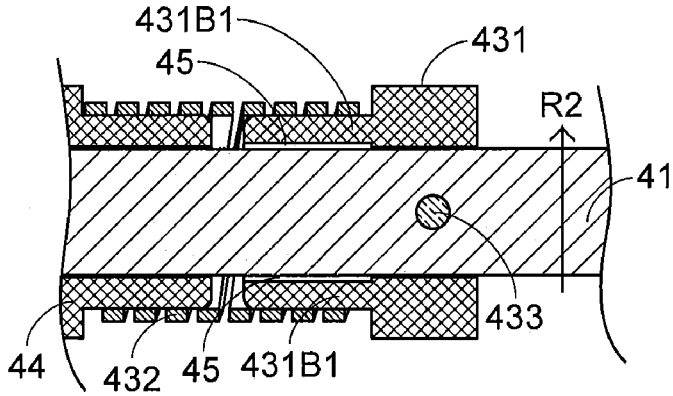
FIG. 3B is a schematic cross-sectional view illustrating the spring clutch when the sheet pick-up device is in a ready position.
Figure 3C:
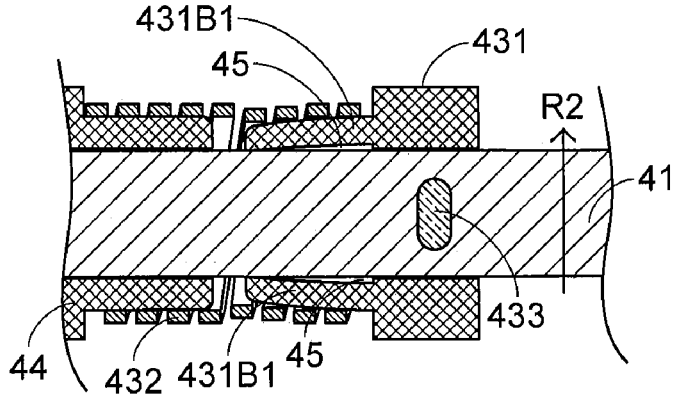
FIG. 3C is a schematic cross-sectional view illustrating the spring clutch when the sheet pick-up device touches the upper cover.

Hereinafter, the operations of the spring clutch 43 will be illustrated in more details with reference to the cross-sectional views of FIGS. 3A, 3B and 3C. As shown in FIG. 3A, when the driving shaft 41 is rotated in the direction R1, the spring 432 is relaxed. Meanwhile, the driving shaft 432 is freely rotated to descend the sheet pick-up arm 42 to the sheet feeding position. Next, as shown in FIG. 3B, when the sheet feeding operation is terminated, the driving shaft 41 is rotated in the direction R2 and the spring 432 is compressed to nip the claw member 431B. Due to a frictional force generated between the spring 432 and the claw member 431B, the sheet pick-up arm 42 is raised to the ready position. Afterward, as shown in FIG. 3C, when the driving shaft 21 is continuously rotated in the direction R2 and the sheet pick-up arm 42 is further raised to touch the upper cover (not shown), the spring 432 is more compressed in response to the counterforce exerted by the upper cover. Meanwhile, the claw pieces 431B1 of the claw member 431B are deformed and thus the contact area between the claw member 431B and the spring 432 is reduced. Due to the reduced contact area between the claw member 431B and the spring 432, the frictional force generated between the spring 432 and the claw member 431B is also decreased. For overcoming the compressive force generated from the compressed spring 432, idle running actions of the collar 431 and the driving shaft 41 are rendered. Under this circumstance, the possibility of striking the upper cover and/or uplifting the upper cover by the sheet pick-up arm 42 is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet pick-up device comprising:

a driving shaft;

a sheet pick-up arm pivotally coupled to said driving shaft;

a collar sheathed around said driving shaft and synchronously rotated with said driving shaft, wherein a claw member is extended from an end of said collar, and said claw member includes a plurality of deformable claw pieces, wherein said claw pieces deform from an undeformed position enclosing a surface of said driving shaft to a deformed position contacting said surface of said driving shaft; and a spring sheathed around said driving shaft, and including a first end fixed to said sheet pick-up arm and a second end sheathed around the outer periphery of said claw member.

2. The sheet pick-up device according to claim 1 wherein said plurality of deformable claw pieces are discretely arranged at a regular interval.

3. The sheet pick-up device according to claim 1 wherein a gap is formed between each claw piece and said surface of said driving shaft.

4. The sheet pick-up device according to claim 1 wherein said sheet pick-up arm comprises a sheet pick-up roller and a sheet separation roller.

5. A sheet pick-up device comprising:

a driving shaft;

a sheet pick-up aim pivotally coupled to said driving shaft, wherein said sheet pick-up arm comprises a sheet pick-up roller and a sheet separation roller;

a collar sheathed around said driving shaft and synchronously rotated with said driving shaft, wherein a claw member is extended from an end of said collar, and said claw member includes a plurality of deformable claw pieces discretely arranged at a regular interval, wherein said claw pieces deform from an undeformed position enclosing a surface of said driving shaft to a deformed position contacting said surface of said driving shaft, wherein a gap is formed between each said claw piece and said surface of said driving shaft in said undeformed position; and a spring sheathed around said driving shaft, and including a first end fixed to said sheet pick-up arm and a second end sheathed around the outer periphery of said claw member.

* * * * *